United States Patent [19]

Mimura et al.

[11] 4,347,203

[45] Aug. 31, 1982

[54] PROCESS FOR PRODUCING ACRYLIC FIBER

[75] Inventors: Koji Mimura, Hiroshima; Yasunori Kawachi, Ohtake; Atsushi Kawai, Hiroshima, all of Japan

[73] Assignee: Mitsubishi Rayon Company, Ltd., Tokyo, Japan

[21] Appl. No.: 152,172

[22] Filed: May 22, 1980

[30] Foreign Application Priority Data

May 30, 1979 [JP] Japan ..... 54-67185
Jun. 5, 1979 [JP] Japan ..... 54-70415

[51] Int. Cl.[3] ..... B29D 27/00; B29F 3/10

[52] U.S. Cl. ..... 264/41; 264/171; 264/182; 428/374; 428/398

[58] Field of Search ..... 428/374; 264/171, 182, 264/41

[56] References Cited

U.S. PATENT DOCUMENTS

| | | | |
|---|---|---|---|
| 3,639,204 | 2/1972 | Ohki et al. | 264/171 |
| 3,885,013 | 5/1975 | Sato | 264/182 |
| 3,975,486 | 8/1976 | Sekiguchi et al. | 264/182 |
| 3,976,737 | 8/1976 | Sekiguchi et al. | 264/182 |

FOREIGN PATENT DOCUMENTS

| | | | |
|---|---|---|---|
| 40-13698 | 7/1965 | Japan | 264/182 |
| 51-149922 | 12/1976 | Japan . | |
| 51-149923 | 12/1976 | Japan . | |
| 1532668 | 11/1978 | United Kingdom . | |
| 1532770 | 11/1978 | United Kingdom . | |

OTHER PUBLICATIONS

"Studies on Acrylic Fibers", by Takeda, Kogyo Kagaku Zasshi 67, 630–632, (1964).

*Primary Examiner*—Jay H. Woo
*Attorney, Agent, or Firm*—Oblon, Fisher, Spivak, McClelland & Maier

[57] ABSTRACT

An acrylic fiber having linen- or cotton-like feeling, dry feeling, a high hygroscopicity and a high water retentivity, which is characterized in that said fiber is covered on the outside with creases running along the fiber axis, adjacent creases being 0.1 to 5$\mu$ apart on the average; has in any of its cross-sections two or more macrovoids, 2$\mu$ or more in major diameter, which extend in the direction of fiber axis; and said fiber has 30 to 150 microcrimps per 25 mm of fiber length. A method for producing such a fiber is also disclosed.

4 Claims, 5 Drawing Figures

PROCESS FOR PRODUCING ACRYLIC FIBER

This invention relates to acrylonitrile-based fiber having a novel feeling. More particularly, it relates to acrylonitrile-based fiber having linen- or cotton-like feeling, water absorptive property, water retentive property, and dry feeling.

The fiber of this invention has in any of its cross-sections two or more macrovoids, 2μ or more in cross-sectional major diameter, which extend in the direction of fiber axis; is covered on the outside with a great number of creases running along the fiber axis, adjacent creases being 0.1 to 5μ apart on the average; and has 35 to 150 crimps per 25 mm of fiber length. The fiber of this invention is produced by the wet spinning process, particularly by the side-by-side conjugate spinning process, under such conditions that the ratio of spinning draft to maximum spinning draft is 0.5 to 0.9.

Acrylic fiber having internal microvoids, 1μ or less in pore diameter and prolonged in the direction of fiber axis has been known as a fiber possessing favorable hygroscopicity, as described in patent documents such as, for example, British Pat. Nos. 1,345,266, 1,532,668 and 1,532,770; Japanese Patent Application Kokai (Laid-open) Nos. 149,922/76 and 149,923/76. The cross-sectional structures of the fibers produced by the methods described in the above documents are as shown in the drawings attached to British Pat. Nos. 1,532,668 and 1,532,770. These fibers have good hygroscopicity but feel wool-like to the touch. U.S. Pat. No. 3,639,204 has disclosed conjugate acrylic fiber of the side-by-side type having 48 crimps per 25 mm of fiber length. This solid fiber is very harsh to the touch and does not suit for the apparel. The raw material for this fiber is a copolymer of acrylonitrile and a higher-alkyl acrylate having 5 to 14 carbon atoms in the alkyl group. Such a copolymer is tacky and the filaments tend to fuse together during spinning and cause end breakage. Moreover, the fiber does not show linen- or cotton-like feeling, desirable hygroscopicity and water retentivity, or dry feeling.

Acrylonitrile fibers having wool-like feeling and excellent physical and chemical properties have been well known and used in the field of winter clothing and underwear which require warmth. Because of their warm feeling and insufficient dry feeling, these acrylic fibers are not suitable for spring and summer clothing which require cool feeling and hygroscopicity. Such characteristics have limited the use range of acrylic fibers. It is generally considered, therefore, that if the acrylic fiber is imparted with linen- or cotton-like feeling, dry feeling, hygroscopicity and water retentivity which are lacking in conventional acrylic fibers, the acrylic fiber will acquire those characteristics which are required for the spring and summer clothing, resulting in enlargement of the use field of the acrylic fiber. For this reason, researches are under way in the fiber circles to develop hygroscopic fibers having a large number of internal fine pores. For instance, British Pat. No. 1,345,266 has disclosed a fiber having a porosity of 4.0 to 63.2%, a free surface area of $1.0\times10^4$ to $1.7\times10^6$ $cm^2/g$, and an angle of contact with water of 45° or less. Because of its large free surface area, this acrylic fiber has an excellent hygroscopicity. Since the pore formed within the fiber is very fine and the exterior surface is comparatively smooth, the said fiber feels wool-like. A disadvantage of this fiber is its susceptibility to fibrillation caused by the large number of microvoids within the fiber.

Efforts have also been made to improve the method for producing hygroscopic acrylic fibers having a large number of internal microvoids, as disclosed in British Pat. Nos. 1,532,770 and 1,532,668 and Japanese Patent Application Kokai (Laid-open) Nos. 149,922/76 and 149,923/76. The inventions disclosed in said British patents relate to a method for producing acrylic fiber by the dry spinning of a spinning solution comprising a uniform mixture of an acrylonitrile polymer, a good solvent for the polymer, and a poor solvent for the polymer, which has a boiling point higher than that of said good solvent, such as, for example, a polyhydric alcohol. The acrylic fiber produced according to the disclosure has a core-jacket (sheath) structure, the microporous core being capable of adsorbing water while the jacket being insensible to water. Although such a structure improves the fiber having microporous core structure in the resistance against fibrillation, the fiber produced still retains wool-like feeling characteristic of an acrylic fiber.

Disclosed in Japanese Patent Application Kokai (Laid-open) Nos. 149,922/76 and 149,923/76 are methods for producing a microporous acrylic fiber by the wet spinning of a spinning solution comprising a copolymer of acrylonitrile with a vinyl monomer of the general formula (1)

$$CH_2{=}\overset{\overset{R_1}{|}}{C}{-}COO{+}CH_2{-}\overset{\overset{R_2}{|}}{C}HO{\rangle}_{\overline{n}}H \qquad (1)$$

a solvent, and a blowing agent insoluble in water and boiling at 95° C. or lower temperatures, such as, for example, carbon tetrachloride. The resultant fiber also has smooth surface and feels wool-like.

An acrylic fiber having an improved crimpability has been described in U.S. Pat. No. 3,639,204. This fiber is made from an acrylonitrile copolymer comprising 65 to 95% by weight of acrylonitrile and 35 to 5% by weight of a higher-alkyl acrylate having 5 to 14 carbon atoms in the alkyl group and has 10 to 48 crimps per 25 mm fiber length. This fiber has a high bulkiness and a highly wool-like feeling. However, because a higher-alkyl acrylate is used as the comonomer of acrylonitrile, the extruded filaments tend to fuse together and cause end breakage during the high ratio drawing treatment required to produce a highly crimped fiber. This fiber is tacky and feels wool-like. It is difficult to produce a fiber predominant in macrovoids.

Under the circumstances the present inventors advanced the research and have accomplished the present invention. The fiber of this invention is an acrylonitrile-based fiber which has in any of its cross-sections two or more macrovoids, 2μ or more in cross-sectional major diameter, which extend in the direction of fiber axes; is covered on the outside with a great number of creases running along the fiber axis, the adjacent creases being 0.1 to 5μ apart; and has 35 to 150 microcrimps per 25 mm of fiber length. This acrylic fiber is produced by the wet spinning of a spinning solution having a viscosity of 200 poises or less, as measured at 50° C., preferably under such conditions that the ratio of spinning draft to maximum spinning draft is in the range of 0.5 to 0.9. The structure as specified in this invention can be especially efficiently embodied in a conjugate fiber of the side-by-side type made from two acryl copolymers different in the copolymer composition.

The fiber of the present invention is illustrated below with reference to the drawings attached hereto.

Figure 5:
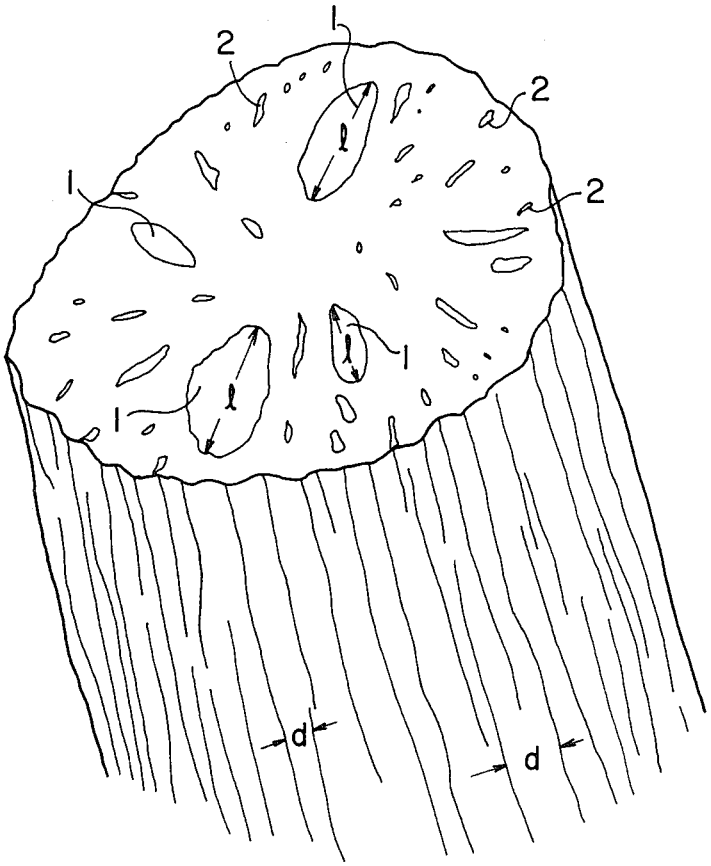
FIG. 5 is an enlarged oblique view of the cross-sectional structure of the present fiber.

In FIG. 5, 1 is the cross-section of a macrovoid, in which the length (l) of major axis is 2μ or more; 2 is the cross-section of a microvoid; and d is the distance between adjacent creases.

Figure 1:
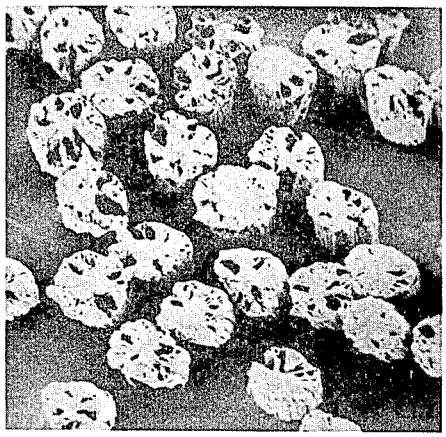
FIG. 1 is an electronmicrograph (×800) of the cross-section of the present fiber.
Figure 2:
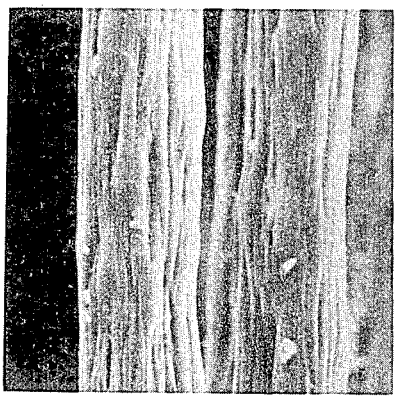
FIG. 2 is an electronmicrograph (×1400) of the longitudinal side of the present fiber.
Figure 3:
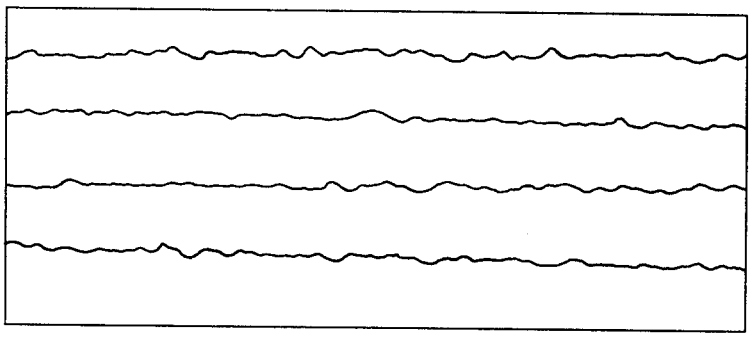
FIG. 3 is projection diagrams representing the microcrimps of the present fiber.

As contrasted to the previously described fibei with plenty of microvoids, the acrylic fiber of this invention has elongated macrovoids in any of its cross-sections two or more macrovoids, as large as 2μ or more in major diameter, as shown in FIGS. 1 and 5; is covered on the outside with a great number of creases, adjacent creases being 0.1 to 5μ (a in FIG. 2) apart, as shown in FIG. 2; and has 30 to 150 crimps per 25 mm of fiber length, as shown in FIG. 3. This fiber hardly becomes fuzzy and has highly linen- or cotton-like feeling as well as dry feeling and a high hygroscopicity.

The acrylic fiber of this invention has on the outside a great number of continuous or discontinuous creases arranged along the fiber axis. The average distance between the adjacent creases should be in the range of 0.1 to 5μ. If these longitudinal creases are more densely arranged or more scattered, the fiber feels neither linen-like nor cotton-like.

The internal voids of the fiber of this invention are macrovoids elongated in the direction of fiber axis, the major diameter (l) of their cross-section being 2μ or more. The fiber is characterized in that these macrovoids are so distributed that any of the cross-sections of the fiber reveals the existence of at least two macrovoids therein. The linen- or cotton-like feeling of the fiber of this invention is the result of combined effect exerted by the said macrovoids and the creases formed on the outside of the fiber. The characteristics of the fiber of this invention are not exhibited in those fibers in which macrovoids narrower than the above specified are predominant or the number of specified macrovoids is so small that most of the cross-sections of the fiber reveals only one macrovoid. The desirable hygroscopicity, water retentivity and dry feeling of the fiber of this invention originate chiefly in the macrovoids as herein specified.

The frequency of microcrimp inserted in the fiber of this invention is 30 to 150, preferably 40 to 150, most preferably 50 to 150 per 25 mm of fiber length, as determined by the method specified in JIS L-1074. It is necessary that the microcrimps be at least 30/25 mm. If they are below 30/25 mm, the fiber will not exhibit linen- or cotton-like feeling and dry feeling even when the fiber has the above-mentioned structure, while if the microcrimps exceed 150/25 mm, the fiber will become harsh to the touch and the object of this invention cannot be achieved.

The conventional acrylic fibers, because of their water retentivities as low as about 10% at most, cannot be a fiber having a linen- or cotton-like feeling. On the other hand, in case of the fiber of the present invention, because of the effects due to the surface structure and the inner specific structure, it is possible to improve the water retentivity to more than 15%, in particular, more than 18%, and therefore, a linen- or cotton-like feeling excellent in properties can be easily obtained.

Further improvements in the hygroscopicity, water retentivity, and linen- or cotton-like feeling can be obtained by the partial or complete hydrolysis of the external surface layer of the fiber or internal surface layers of macrovoids.

The acrylonitrile polymers used in producing the present fiber having improved characteristics are copolymers of 50 to 97% by weight of acrylonitrile and 3 to 50% by weight of other copolymerizable vinyl monomers including vinyl acetate, vinyl chloride, vinyl bromide, acrylamide, methacrylamide, vinylidene chloride, sodium vinylbenzenesulfonate, sodium methallylsulfonate, acrylic acid, methacrylic acid, and alkyl acrylates or alkyl methacrylates having 1 to 3 carbon atoms in the alkyl group.

To prepare a spinning solution, the acrylic polymer is dissolved in a solvent such as, for example, dimethylformamide, dimethylacetamide, dimethyl sulfoxide, aqueous nitric acid, aqueous solutions of rhodanides, and aqueous solutions of zinc chloride so as to obtain a solution having a viscosity of 200 poises or less, as measured at 50° C. The fiber of this invention is produced by wet spinning the spinning solution under the conditions such that the ratio of spinning draft (JS) to maximum spinning draft (MJS) is from 0.5 to 0.9 (vide infra). If the specified viscosity exceeds 200 poises, the fiber of this invention is not efficiently produced by the wet spinning. A preferable viscosity of the spinning solution is in the range of from 30 to 200 poises.

In the wet spinning, with the increase in spinning draft, the production of the intended fiber having the structure specific to the present invention becomes easier. However, if JS becomes too high, the spinning operation becomes unsteady, resulting in more frequent breakage of the fibers. Therefore, in the process of this invention, a suitable JS/MJS ratio is in the range of 0.5 to 0.9. If the ratio is below 0.5, it is impossible to obtain a fiber of the structure specific to this invention, while if it exceeds 0.9, steady spinning operation becomes difficult.

In order to elevate the spinning draft to said range, for example, the following methods may be used:

(i) Increase of draw-off roll speed;

(ii) Reduction of extrusion volume;

(iii) Increase of hole diameter in the spinneret.

Among them, Method (iii) has such an advantage that the single fiber denier of fibers to be produced may be determined as desired.

$$JS = \frac{V_1}{V_o} = \frac{V_1}{\dfrac{V}{\pi \times \left(\dfrac{D}{2}\right)^2 \times H \times 100}} = \frac{25\pi V_1 D^2 H}{V} \quad (2)$$

where $V_0$ = Extrusion speed

V = Extrusion volume

H = Number of holes in the spinneret $V_1$ = Draw-off roll speed

D = Diameter of each hole in the spinneret

In detail, by lowering the viscosity or the concentration of spinning solution, it becomes possible to obtain a fiber having a fine denier and to easily form the macrovoids in the fiber. Further, by use of spinneret having large diameter of hole, it becomes possible to elevate the JS resulting in increasing the effective drawing ratio and to easily form the crease on the surface of the fiber.

When the wet spinning is performed under the above conditions, the macrovoids formed in coagulated filament have a stabilized structure and remain the macrovoid throughout the succeeding treatments of drawing and drying. Thus, the final fiber may meet the requirement that any of the cross-section should contain two or more macrovoids of the specified dimensions.

In the wet spinning under the condition that JS/MJS is 0.5 to 0.9, the spinning draft is larger than in customary wet spinning. For this reason, it is possible by the normal drawing to insert 30 or more microcrimps in 25 cm of fiber length. Such an effect of the ratio JS/MJS is more efficiently exhibited in the conjugate fiber of the side-by-side type. The fiber of this type is produced by the customary conjugate wet spinning technique using two acrylonitrile polymers different in copolymer composition, the difference being 1% by weight or more in the amount of a vinyl monomer copolymerized with acrylontrile.

The coagulation bath for the wet spinning according to this invention is an aqueous solution of the aforementioned solvent for the acrylonitrile polymer.

Further improvements in the linen- or cotton-like feeling, dry feeling, water retentivity and water absorptivity can be obtained by subjecting the fiber of this invention to hydrolysis treatment. The hydrolysis of the fiber proceeds in an acidic or alkaline solution, particularly in 0.5 to 10% aqueous sodium hydroxide solutions at a temperature from 20° C. to the boiling point.

Becaue of its desirable linen- or cotton-like feeling, dry feeling, water retentivity and water absorptivity, the fiber of this invention may find a use field quite different from the field in which conventional acrylic fibers are used by virtue of their wool-like characteristics.

The invention is illustrated below in further detail with reference to Examples.

The water retentivity appearing in Examples was measured according to the following manner.

The fiber tested was immersed in water and subjected to dehydration by using a centrifugal dehydrator (1200 r.p.m.) 20 cm in diameter for 10 minutes. The weight of the fiber after the dehydration was measured. ($W_1$) Then, after completely drying, the weight of the fiber was measured. ($W_0$)

$$\text{Water retentivity (\%)} = \frac{W_1 - W_o}{W_o} \times 100$$

EXAMPLE 1

A copolymer (a) comprising 93% of acrylonitrile and 7% of vinyl acetate and having a specific viscosity of 0.17 (as measured in a 0.1 g/100 ml solution in dimethylformamide at 25° C.) and a copolymer (b) comprising 91% of acrylonitrile and 9% of vinyl acetate and having a specific viscosity of 0.17 were dissolved each in dimethylacetamide to prepare spinning solutions of 18% by weight. (A) and (B) having viscosities (at 50° C.) of 60 poises and 55 poises, respectively. Conjugate spinning was carried out by extruding the two solutions through a distributer having 80 holes and a spinneret having 2,000 holes, each hole 0.10 mm in diameter, into a 50% aqueous dimethylacetamide solution (50° C.) at an extrusion ratio of 50:50 to obtain coagulated filaments in which the two polymers (a) and (b) were bonded together side by side (JS/MJS=0.7). The coagulated filaments were drawn to 5 times the original length in hot water while being washed. The drawn filaments were dried at 140° C., then mechanically crimped, and subjected to relaxation treatment in saturated steam at 135° C. to obtain fiber (1) of 1.2 dpf.

Figure 4:
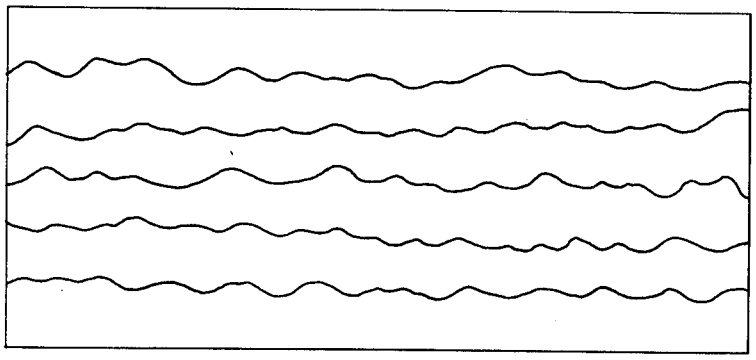
FIG. 4 is projection diagrams representing the crimps of a commercial conjugate acrylic fiber.

The electromicrographs of the cross-sections and longitudinal side of fiber (1) are shown in FIGS. 1 and 2, respectively. The projection diagrams of fiber (1) and a commercial conjugate acrylic fiber are shown in FIGS. 3 and 4, respectively. The cross-sectional oblique view of fiber (1) is shown in FIG. 5. In FIG. 5, d is the distance between the adjacent creases on the outside of fiber; 1 is the macrovoid; and l is the major diameter of the cross-section of the macrovoid.

The conjugate fiber (1) was drawn 1.15 fold, then impressed with mechanical crimp, and cut to 5.1 mm to obtain staple fiber (2) having latent crimpability. The characteristics of both fibers were as shown in the following table.

| | Denier (d) | Strength (g/d) | Elongation (%) | Number of crimps per 25 mm | Macrovoid: Average major dia. (μ) | Macrovoid: Number | Average distance between creases (μ) |
|---|---|---|---|---|---|---|---|
| Fiber (1) | 1.20 | 2.9 | 34 | 73 | 3 | 3 or more | 1.8 |
| Fiber (2) | 1.19 | 2.8 | 31 | 10.5 | 3 | 3 or more | 1.8 |

Fiber (2) and common acrylic staple fiber (1.2 dpf) were blended in various ratios and spun to obtain blended yarns (48 count). Each yarn was dyed in boiling bath to develop the crimp and made into knitted fabric to compare the feeling.

| Blending ratio, fiber (2)/ common acrylic fiber | Feeling of knitted fabric | Water retentivity (wt %) |
|---|---|---|
| 100/0 | Soft, dry feeling; high bulkiness | 23° |
| 70/30 | Soft, dry feeling; high bulkiness | — |
| 30/70 | Soft | — |
| 0/100 | Soft; low bulkiness | 8 |

EXAMPLE 2

The blended yarns obtained in Example 1 were hydrolyzed in an aqueous sodium hydroxide solution (15 g/liter) at 70° C., then dyed and knitted. The hygroscopicity and the water retentivity were found markedly increased.

| Blending ratio, fiber (2)/ common acrylic fiber | Moisture regain (%), hydrolyzed | | Moisture regain (%), unhydrolyzed | | Water retentivity (wt %) |
|---|---|---|---|---|---|
| | 65% RH | 93% RH | 65% RH | 93% RH | |
| 100/0 | 3.9 | 6.4 | 2.4 | 4.1 | 31 |
| 70/30 | 3.2 | 5.1 | — | — | — |
| 30/70 | 2.1 | 3.3 | — | — | — |
| 0/100 | 1.3 | 2.7 | 1.1 | 2.5 | 11 |

EXAMPLE 3

A copolymer (intrinsic viscosity 1.15, as measured in dimethylformamide at 25° C.) comprising 93% of acrylonitrile, 6.6% of methyl acrylate and 0.4% of sodium vinylbenzenesulfonate was dissolved in dimethylacetamide to prepare a spinning solution having a solids content of 18% and a viscosity (at 50° C.) of 55 poises. The spinning solution was spun through a spinneret, 0.12 mm in hole diameter, into 50% aqueous dimethylacetamide solution at 50° C. The spinning draft (JS) was 1.2 [the maximum spinning draft (MJS) was found to be 1.8 under the above conditions; JS/MJS=1.2/1.8=0.67]. The undrawn filaments were drawn in boiling water to 5 times the original length, dried at 140° C., and subjected to relaxation treatment in saturated steam at 135° C. There was obtained a fiber (3 denier) having creases running in the direction of fiber axis and internal voids.

| | |
|---|---|
| Strength | 2.5 g/d |
| Elongation | 31% |
| Spacing between creases (average) | 1.8μ |
| Void (2μ or more in major diameter) | 2 or more in the cross-section of single fiber |

The above fiber was cut to 76 mm and spun, knitted, and dyed in a customary manner. The feel of the knitted fabric closely resembled that of cotton fabric, which the knitted fabric of conventional acrylic fibers lacks entirely. The knitted fabric was treated with an aqueous sodium hydroxide solution (15 g/liter) at 70° C. for 15 minutes. The treated knitted fabric was found to be improved in hygroscopicity and water retentivity as shown below.

(A) (1) Equilibrium moisture regain at 65% RH (20° C.): 3.3%

(2) Equilibrium moisture regain at 93% RH (20° C.): 5.7%

(B) Water retentivity: 29%

What is claimed is:

1. A method for producing an acrylic fiber, which comprises wet-spinning a spinning solution having a viscosity of about 30 to 60 poises, as measured at 50° C. and containing acrylonitrile polymer, under such spinning conditions that the ratio of spinning draft to maximum spinning draft is in the range of 0.5 to 0.9 and subjecting the spun filament to successive washing, drawing and drying treatments to produce a fiber which is covered on the outside with creases running along the fiber axis, adjacent creases being 0.1 to 5μ apart on the average; which has in any of its cross-sections two or more macrovoids, 2μ or more in major diameter, which extend in the direction of fiber axis; and which has 30 to 150 microcrimps per 25 mm of fiber length.

2. A method for producing an acrylic fiber according to claim 1, wherein the spinning is performed by the method for producing a conjugate fiber of the side-by-side type using two acrylic polymers different in thermal contraction coefficient.

3. A method for producing an acrylic fiber according to claim 1, characterized by drying at a temperature of about 140° C.

4. A method for producing an acrylic fiber according to claims 1 or 3, characterized by using, as a coagulation bath, an aqueous solution of dimethyl formamide, dimethyl acetamide or dimethyl sulfoxide.

* * * * *